US008888389B2

(12) United States Patent
Morishita et al.

(10) Patent No.: US 8,888,389 B2
(45) Date of Patent: Nov. 18, 2014

(54) PRINTER AND CUTTER APPARATUS

(71) Applicant: Star Micronics Co., Ltd., Shizuoka (JP)

(72) Inventors: Masaaki Morishita, Shizuoka (JP); Tomoyuki Kondo, Shizuoka (JP)

(73) Assignee: Star Micronics Co., Ltd., Shizuoka-Shi (JP)

( * ) Notice: Subject to any disclaimer, the term of this patent is extended or adjusted under 35 U.S.C. 154(b) by 44 days.

(21) Appl. No.: 13/761,286

(22) Filed: Feb. 7, 2013

(65) Prior Publication Data

US 2013/0223912 A1 Aug. 29, 2013

(30) Foreign Application Priority Data

Feb. 27, 2012 (JP) ..... 2012-039666

(51) Int. Cl.

| | |
|---|---|
| ***B41J 11/70*** | (2006.01) |
| ***B41J 11/66*** | (2006.01) |
| ***B26D 1/09*** | (2006.01) |
| ***B26D 7/26*** | (2006.01) |
| *B26D 1/00* | (2006.01) |
| *B26D 7/00* | (2006.01) |
| *B26D 3/10* | (2006.01) |
| *B26D 5/16* | (2006.01) |

(52) U.S. Cl.

CPC ..... *B41J 11/66* (2013.01); *B26D 1/095* (2013.01); *B26D 7/2628* (2013.01); *B41J 11/70* (2013.01); *B26D 2001/0033* (2013.01); *B26D 2001/0066* (2013.01); *B26D 2007/005* (2013.01); *B26D 3/10* (2013.01); *B26D 5/16* (2013.01)

USPC ..... 400/621; 83/568; 83/569; 83/623

(58) Field of Classification Search

USPC ..... 400/621

See application file for complete search history.

(56) References Cited

U.S. PATENT DOCUMENTS

| | | | | |
|---|---|---|---|---|
| 720,896 | A * | 2/1903 | Cornelius et al. | 83/518 |
| 5,058,473 | A * | 10/1991 | Yamada | 83/371 |
| 5,347,699 | A * | 9/1994 | Ward | 83/584 |
| 6,405,625 | B1 * | 6/2002 | Nomura et al. | 83/618 |
| 7,604,426 | B2 * | 10/2009 | Hanaoka et al. | 400/621 |
| 8,596,894 | B2 * | 12/2013 | Hanaoka | 400/621 |

FOREIGN PATENT DOCUMENTS

| | | |
|---|---|---|
| JP | 2002-128378 | 5/2002 |
| JP | 2005-59502 | 3/2005 |
| JP | 2005-230990 | 9/2005 |
| JP | 2009-107090 | 5/2009 |

* cited by examiner

*Primary Examiner* — Jill Culler

(74) *Attorney, Agent, or Firm* — Lexyoume IP Meister, PLLC

(57) ABSTRACT

A printer and a cutter apparatus configured to provide a sure full cut without producing an undesirable flake of paper. The cutter apparatus comprises a fixed blade, a first movable blade disposed on one side in a width direction of the paper and configured to move back and forth with respect to the fixed blade, a second movable blade disposed on the other side in the width direction of the paper with a gap provided with respect to the first movable blade and configured to move back and forth with respect to the fixed blade, and an urging member configured to urge each of the first movable blade and the second movable blade in a direction reducing the gap.

6 Claims, 5 Drawing Sheets

PRINTER AND CUTTER APPARATUS

CROSS-REFERENCE TO RELATED APPLICATION

The present application claims priority to Japanese Patent Application No. 2012-039666 filed on Feb. 27, 2012, which is incorporated herein by reference as if reproduced in its entirety.

BACKGROUND OF THE INVENTION

The present invention relates to a cutter apparatus and a printer with a cutter apparatus.

Conventionally, there has been a printer that stores a paper roll and prints onto the paper drawn from the paper roll. Such printer is provided with a cutter apparatus to separate a printed portion, which is part of the paper that is printed, from the non-printed portion of the paper. The cutter apparatus includes a guillotine-type cutter apparatus, which includes a fixed blade made of a plate and a movable blade made of a plate reciprocating with respect to the fixed blade. Such guillotine-type cutter apparatus is disclosed in patent documents such as Japanese Patent No. 4455091 (Document 1), Japanese Unexamined Publication No. 2005-59502 (Document 2), and Japanese Unexamined Publication No. 2002-128378 (Document 3).

The movable blade of the cutter apparatus disclosed in Documents 1-3 is made of a single plate having a V-shape cutting edge gradually projecting in the advancing direction of the movable blade toward the ends of the cutting edge. The movable blade is moved toward the fixed blade opposite until the cutting edge of the movable blade slides across the cutting edge of the fixed blade to cut the paper. In this type of cutter apparatus, when the movable blade is moved toward the fixed blade, the V-shape cutting edge of the movable blade is brought into contact with the cutting edge of the fixed blade at two points, one of which is at one side and the other is at the other side in the width direction of the paper. The paper caught between the movable blade and the fixed blade is gradually cut at the two points as the movable blade is moved toward the fixed blade.

Further, another cutter apparatus including a first movable blade disposed on one side in the width direction of the paper and a second movable blade disposed on the other side in the width direction of the paper is known, as disclosed in patent documents such as Japanese Unexamined Publication No. 2009-107090 (hereinafter referred to as Document 4). The cutter apparatus disclosed in Document 4 includes the first movable blade made of a plate and the second movable blade made of a plate (hereinafter, collectively referred to as the movable blades) respectively having a straight-line cutting edge gradually projecting in the advancing direction of the movable blade toward the end of the paper in the width direction. The first movable blade and the second movable blade touch each other at the center in the width direction of the paper. When the movable blades are moved toward the fixed blade, each of the cutting edges of the movable blades is brought into contact with the cutting edge of the fixed blade at a point. The paper caught between the movable blades and the fixed blade is gradually cut at the two points as the movable blades are moved toward the fixed blade.

A notch is formed in the cutting edge of one of the movable blades at the position where the movable blades meet each other. The notch is extended toward the opposite direction to the advancing direction (hereinafter referred to as the retracting direction) of the movable blade. A portion of the paper is left uncut by the notch. The notch thus provides a partial cut. The notch has an auxiliary cutting edge at the end in the retracting direction. In this type of cutter apparatus, the movable blades are moved in the advancing direction until the auxiliary cutting edge overlaps the fixed blade to cut the uncut portion off, thus providing a full cut.

As discussed above, in the cutter apparatus of Documents 1-3, the V-shape cutting edge of the movable blade is brought into contact with the cutting edge of the fixed blade at both sides across the paper in the width direction. It is preferable that an appropriate pressure is constantly applied to both of the two points. However, since the movable blade disclosed in Documents 1-3 is made up of a single plate, the contact pressure at one point likely has an influence on the other point. For example, a variation in dimension, assembly or cutting load would influence the contact pressure, resulting in the increase in pressure at one point and the decrease in pressure at the other point. Due to the increase in pressure, part of the blade is possibly subject to wear, resulting in a shortened lifetime of the cutter. Decrease in pressure possibly results in a cut in failure.

In the cutter apparatus of Document 4, each of the cutting edge of the first movable blade and the second movable blade is independently brought into contact with the cutting edge of the fixed blade at a point. The influence of one point on the other point is therefore comparatively less, but friction force is undesirably generated at the portion where the first movable blade and the second movable blade touch each other. This friction force possibly reduces the contact pressure of the movable blades on the fixed blade. Reduction in pressure results in a cut in failure.

FIG. 5A is a schematic view of a paper partially cut by the cutter apparatus of prior art of Document 4.

In the cutter apparatus of Document 4, an uncut portion P1 is formed corresponding to the notch formed in the cutting edges of the movable blade when the movable blades are advanced toward the fixed blade. In FIG. 5A, the uncut portion P1 is represented by a dotted line. As the movable blades are further advanced, a cut P2 is formed in the printed part PP, of which depth corresponds to the thickness of the movable blade. The cut P2 is formed at the ends of the uncut portion P1 mainly by the advancing edge of the notch having a thickness of the movable blade.

FIG. 5B is a schematic view of the paper fully cut by the cutter apparatus of prior art of Document 4.

As the both movable blades are further moved after the uncut portion P1 is formed, the printed part PP is pushed in the thickness direction of the paper P, which is the advancing direction of the movable blades. Subsequently, the printed part PP is further pushed by the movable blades upward in a direction away from non-printed part PN. Being pushed upward, the printed part PP is unintentionally torn off the non-printed part PN at the ends P3 of the cut P2. This possibly occurs even when the printed part PP is only pushed in the thickness direction of the paper P.

When the printed part PP is unintentionally torn off the non-printed part PN around the ends P3 of the cut P2, part of paper is left as a protrusion P4 in the non-printed part PN. Subsequently, the protrusion P4 is separated from the non-printed part PN when the uncut portion P1 is cut by the auxiliary cutting edge. The separated protrusion, which is a flake of paper, drops inside the printer, possibly disturbing the paper conveyance and thereby causing a paper jam. Further, the flake of paper possibly enters inside the mechanism, causing a malfunction of the printer. In addition, the printed part PP discharged from the printer has a bad looking due to the lack corresponding to the protrusion P4.

SUMMARY

In order to solve the aforementioned problems, an object of the present invention is to provide a printer and a cutter apparatus configured to provide a sure full cut without producing an undesirable flake of paper.

To achieve the above object, according to the present invention, a cutter apparatus is provided, that comprises a fixed blade, a first movable blade disposed on one side in the width direction of the paper and configured to move back and forth with respect to the fixed blade, a second movable blade disposed on the other side in the width direction of the paper with a gap provided with respect to the first movable blade and configured to move back and forth with respect to the fixed blade, and an urging member configured to urge each of the first movable blade and the second movable blade in a direction reducing the gap.

In the cutter apparatus of the present invention, the gap between the first movable blade and the second movable blade is maintained to have a desired gap width since the movement of the movable blades in the width direction of the paper are restricted by the urging member. Accordingly, the gap between the cutting edges of the first movable blade and the second movable blade can be set to be extremely narrow without a risk that the first movable blade and the second movable blade touch each other. Since the gap between the cutting edges of the first movable blade and the second movable blade is extremely narrow, an extremely narrow portion of the paper is left uncut. Therefore, only when the movable blades are advanced a little after the gap reaches the fixed blade, the uncut portion is torn off and the printed part is thereby separated from the non-printed part. As a result, a sure full cut is provided without producing an undesirable flake of paper.

The cutter apparatus may be provided with a driving mechanism for moving the first movable blade and the second movable blade toward the fixed blade.

The cutter apparatus may be provided with another urging member that urges the cutting edge of the first movable blade and the cutting edge of the second movable blade respectively toward the cutting edge of the fixed blade in the thickness direction of the movable blades.

Further, the second movable blade may be disposed to be adjacent to the first movable blade in the width direction of the paper.

Further, the first movable blade may be a plate of a thickness and the second movable blade may be a plate of another thickness. The width of the gap may be half or less the thickness of the movable blade, whichever the movable blade is thicker.

Further, the second movable blade and the first movable blade may be disposed with a gap provided therebetween in the width direction of the paper.

The cutter apparatus may be provided with a first mounting member on which the first movable blade is mounted and a second mounting member on which the second movable blade is mounted, wherein at least one of the first movable blade and the second movable blade may be positionally adjustable in the width direction of the paper with respect to the relevant mounting member.

The gap between the first movable blade and the second movable blade may be adjustable to a desired value by positionally adjusting at least one of the first movable blade and the second movable blade in the width direction of the paper.

In the cutter apparatus of the present invention, each of the first movable blade and the second movable blade may include an engagement portion with which a jig is engaged, the jig being used to define the width of the gap when each of the first movable blade and the second movable blade is mounted on the relevant mounting member.

Due to the engagement portion with which the jig is engaged, the cutter apparatus is easily assembled with a desired gap assured between the first movable blade and the second movable blade.

The engagement portion may be a hole, a depressed portion or a protrusion.

To achieve the above object, according to the present invention, a printer is provided, that comprises a conveying unit configured to convey a paper, a printing unit configured to print on the paper conveyed by the conveying unit, a cutter apparatus provided downstream than the printing unit in the paper conveying direction. According to the above configuration, production of an undesirable flake of paper is prevented, and paper jam and malfunction of the printer mechanism is therefore prevented.

A printer and a cutter apparatus according to the present invention provides a sure full cut without producing an undesirable flake of paper.

DETAILED DESCRIPTION

Hereinafter, embodiments of the present invention will be described with reference to the accompanying drawings. A cutter apparatus according to an exemplary embodiment of the present invention may be mounted on a printer that stores a paper roll and prints onto the paper drawn from the paper roll. In the exemplary embodiment provided herein, a cutter apparatus is mounted on a thermal printer. However, the cutter apparatus may be mounted on various other apparatuses, such as a paper storing apparatus or a paper conveying apparatus.

Figure 1:
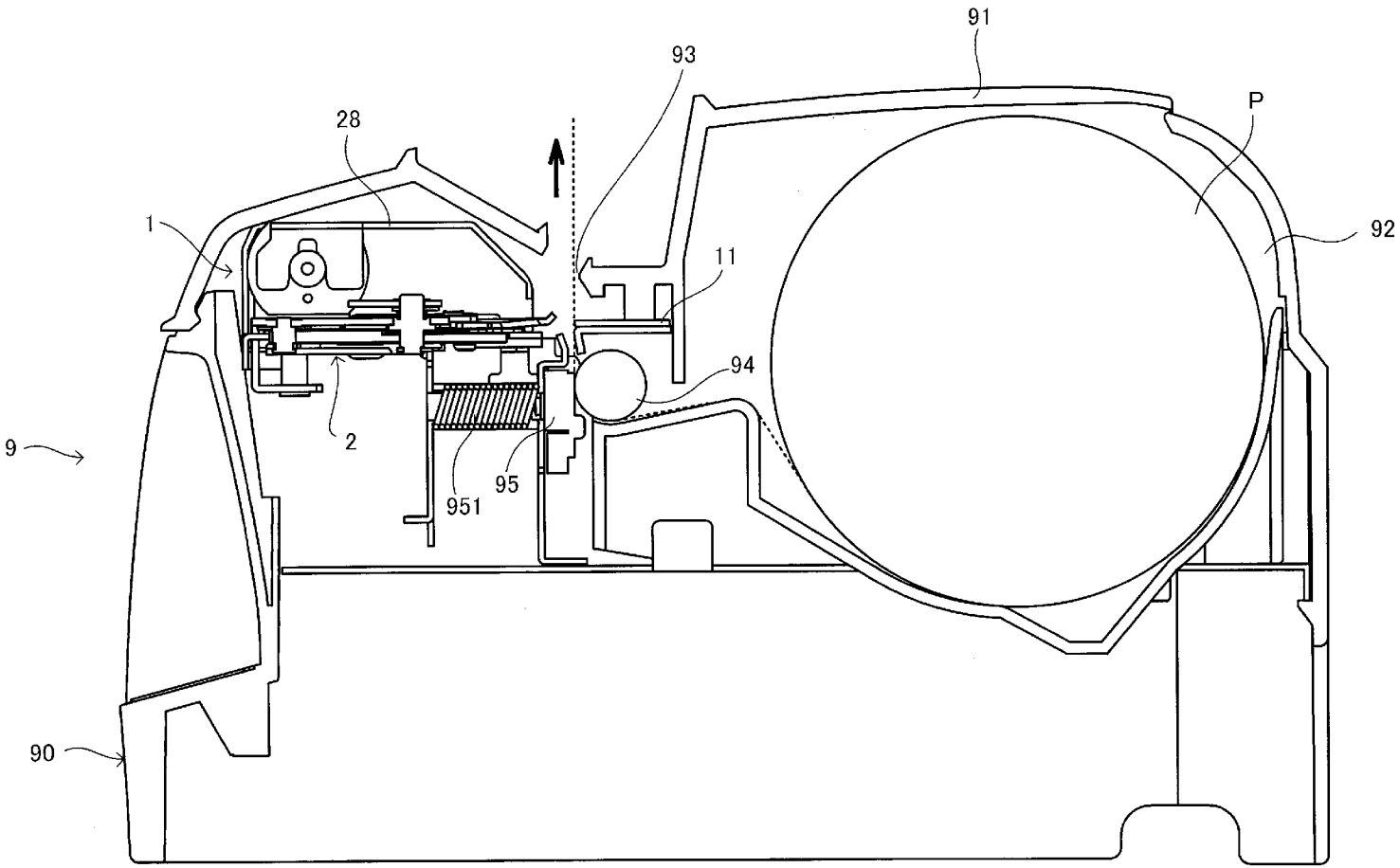
FIG. 1 is a cross-sectional view of a thermal printer provided with a cutter apparatus.

FIG. 1 is a cross-sectional view of a thermal printer provided with a cutter apparatus according to an exemplary embodiment of the present invention. In FIG. 1, the left side of the drawing is the front side of the thermal printer 9 and the right side of the drawing is the rear side of the thermal printer 9.

Referring FIG. 1, a paper storing unit 92, which is closed by a cover 91 of a thermal printer 9, accommodates a paper P in roll-type. The cover 91 is pivotably supported by the body 90 of the printer 9 at the rear side thereof. A discharge port 93 for discharging the paper P is provided between the body 90 and a front part of the cover 91. In this thermal printer 9, a route connecting between the paper storing unit 92 and the discharge port 93 provides a paper conveying path. In FIG. 1, the paper P drawn from the paper storing unit 92 is conveyed along the paper conveying path as illustrated by a dotted line. Further, the conveying direction is illustrated by an arrow mark.

The thermal printer 9 of FIG. 1 includes a platen roller 94, a thermal head 95 and a cutter apparatus 1. The platen roller 94 is merely an exemplary embodiment of the conveying unit and the thermal head 95 is merely an exemplary embodiment of the printing unit. Hereinafter, one side of the paper P onto which the thermal head 95 prints may be referred to as the front of the paper and the other side may be referred to as the back of the paper. The platen roller 94 is extended in a width direction of the paper P (the direction to vertical to the paper surface of FIG. 1) and rotated by a motor which is not illustrated. The platen roller 94 is positioned beside the paper conveying path so as to face the back of the paper P drawn from the paper storing unit 92.

The thermal head 95 is positioned beside the paper conveying path so as to face the front of the paper P drawn from the paper storing unit 92. The thermal head 95 is extended in the width direction of the paper P and urged toward the platen roller 94 by a head spring 951. The paper P drawn from the paper storing unit 92 is caught between the platen roller 94 and the thermal head 95. And, the paper P is conveyed to the discharge port 93 along the paper conveying path by the rotation of the platen roller 94. The thermal head 95 is provided with a plurality of heating elements arranged in the width direction of the paper P. A printer controller, which is not illustrated, selectively activates the heating elements to produce a printing on the paper P.

The cutter apparatus 1 is provided downstream than the thermal head 95 and before the discharge port 93. The cutter apparatus 1 cuts the paper P along the width direction of the paper P to separate the printed part from the non-printed part of paper.

The cutter apparatus 1 is provided with a fixed blade 11 and a movable blade unit 2. The fixed blade 11 is disposed in the back side of the paper P. The fixed blade 11 is fixed to the cover 91 with a screw which is not illustrated. The movable blade unit 2 is disposed in the front side of the paper P to face the fixed blade 11 across the paper conveying path. The movable blade unit 2 is fixed to the body 90 with a screw which is not illustrated. The fixed blade 11 may be disposed in the front side of the paper P and the movable blade unit 2 may be disposed in the back side of the paper P.

Figure 2:
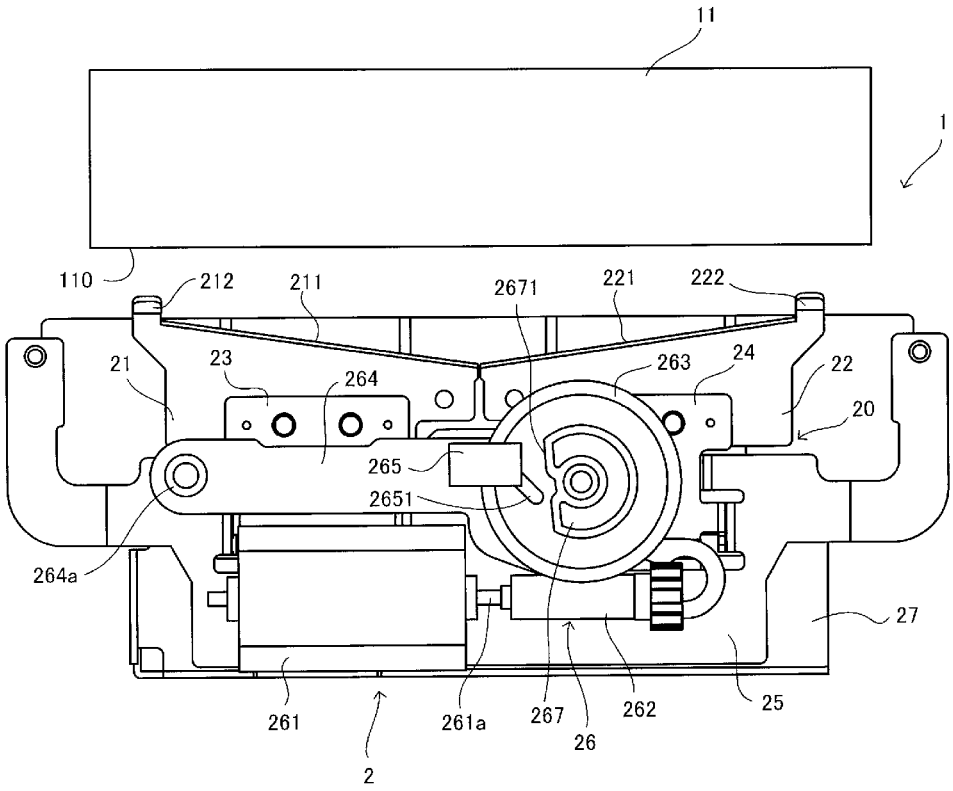
FIG. 2 is a top view of the cutter apparatus provided on the thermal printer of FIG. 1.

FIG. 2 is a top view of the cutter apparatus of the thermal printer of FIG. 1. The left-and-right direction of FIG. 2 is the width direction of the paper P. Hereinafter, one side of the width direction of the paper P may be referred to as the left side and the other side as the right side. Further, the lower side in the up-and-down direction of FIG. 2 corresponds to the front side of the paper P and also the front side of the thermal printer 9. The upper side corresponds to the back side of the paper P and also the rear side of the thermal printer 9.

As shown in FIG. 2, the fixed blade 11 is made of a stainless plate having a rectangular shape, when viewed from the top, of which longitudinal side is extended along the width direction of the paper P. The fixed blade 11 has a cutting edge 110 at the longitudinal side facing the movable blade unit 2. The cutting edge 110 is straightly stretched in the width direction of the paper P.

The movable blade unit 2 is provided with a slide unit 20, a driving mechanism 26 that reciprocates the slide unit 20, a cutter frame 27, and a cutter cover 28 (referring FIG. 1) fixed to the cutter frame 27. In FIG. 2, the cutter cover 28 is not shown. The slide unit 20 includes a first movable blade 21, a second movable blade 22, a first mounting member 23 on which the first movable blade 21 is mounted, a second mounting member 24 on which the second movable blade 22 is mounted, and a slide frame 25 on which the first mounting member 23 and the second mounting member 24 are mounted. The slide unit 20 is movably mounted on the cutter frame 27 to move toward the fixed blade 11 in the advancing direction and to move away from the fixed blade 11 in the retracting direction. The reciprocating direction of the slide unit 20 (the up-and-down direction of FIG. 2) is the perpendicular direction to the width direction of the paper P.

The first movable blade 21 is disposed on the left side of the movable blade unit 2. The second movable blade 22 is disposed on the right side of the movable blade unit 2 to be coplanar with the first movable blade 21. Both of the first movable blade 21 and the second movable blade 22 are made of a stainless plate with a thickness of 1 mm.

The first movable blade 21 has a guide 212 provided at the left end thereof, which protrudes toward the fixed blade 11, and a cutting edge 211 straightly stretched along the side facing the fixed blade 11 except the portion where the guide 212 is provided. The cutting edge 211 of the first movable blade 21 is sloping up toward the guide 212 so that it is gradually projecting in the advancing direction of the first movable blade 21 (the direction toward the fixed blade 11). The second movable blade 22 has a guide 222 provided at the right end thereof, which protrudes toward the fixed blade 11, and a cutting edge 221 straightly stretched along the side facing the fixed blade 11 except the portion where the guide 222 is provided. The cutting edge 221 of the second movable blade 22 is sloping up toward the guide 222 so that it is gradually projecting in the advancing direction of the second movable blade 22 (the direction toward the fixed blade 11).

The driving mechanism 26 includes a motor 261 fixed to the cutter cover 28, a worm gear 262, a worm wheel 263, a swiveling arm 264, and a HP sensor 265. The worm gear 262 is fixed to a spindle 261*a* of the motor 261 and engaged with the worm wheel 263. The worm wheel 263 is provided with a protrusion which is not illustrated. The swiveling arm 264 has two long holes which are not illustrated. The protrusion of the worm wheel 263 is inserted in one of the two long holes of the swiveling arm 264. When the worm wheel 263 is driven by the motor 261 to make a single rotation, the swiveling arm 264 turns around a pivot 264*a* once.

The slide frame 25 is movably mounted on the cutter frame 27 to move toward the fixed blade 11 in the advancing direction and to move away from the fixed blade 11 in the retracting direction. The slide frame 25 has a protrusion 251 (referring FIG. 3). The protrusion 251 is inserted in the other long hole of the swiveling arm 264. When the swiveling arm 264 turns once, the slide frame 25 is moved toward the fixed blade 11 in the advancing direction and then moved away from the fixed blade 11 in the retracting direction. The first movable blade 21, the second movable blade 22, the first mounting member 23 and the second mounting member 24, which are all mounted on the side frame 25, are also similarly moved. FIG. 2 shows that the slide frame 25 is at the home position which is the farthest position from the fixed blade 11.

The worm wheel 263, as shown in FIG. 2, is provided with a cam 267 rotating along with the worm wheel 263. The circumference of the cam 267 has a cutout portion 2671 and a circular arc portion. The HP sensor 265 is provided with a contactor 2651. When the slide frame 25 is at the home position as shown in FIG. 2, the contactor 2651 faces the cutout portion 2671 of the cam 267, causing the HP sensor 265 to output a non-contact signal to the printer controller. When the worm wheel 263 is rotated, the contactor 2651 is pushed by the circular arc portion of the cam 267, causing the HP sensor 265 to output a contact signal to the printer controller. The printer controller activates the motor 261 in response to the signal from the HP sensor 265 to control the reciprocating movement of the slide unit 20. A controller for activating the motor 261 may be provided on the cutter apparatus 1 to control the reciprocating movement of first movable blade 21 and the second movable blade based on the signal from the HP sensor 265.

Figure 3A:
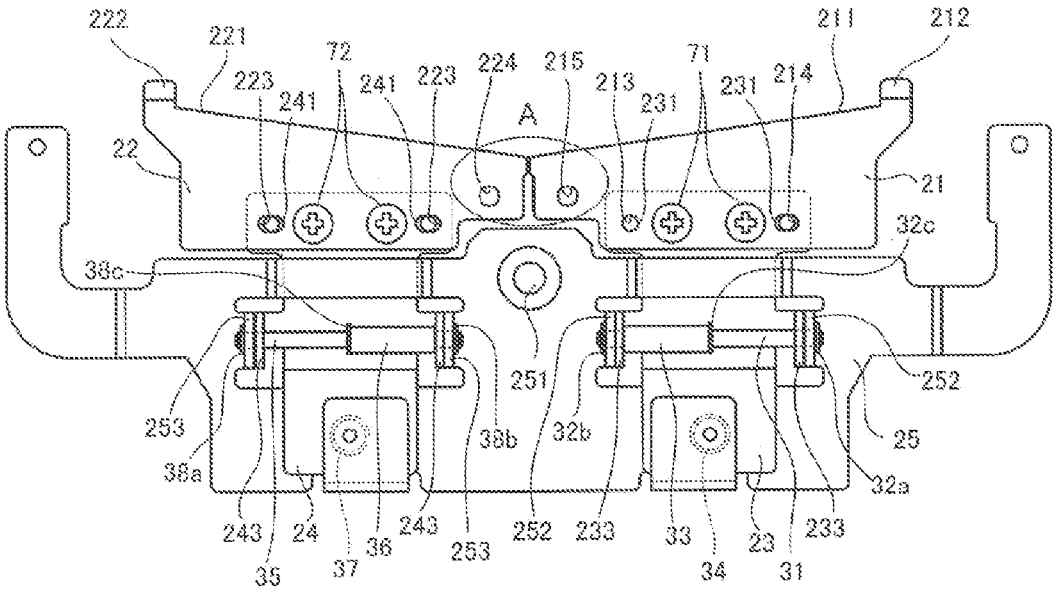
FIG. 3A is a reverse view of a slide unit of the cutter apparatus of FIG. 2.

FIG. 3A is a reverse view of the slide unit of FIG. 2 (a view from the bottom side of the thermal printer). The left-and-right direction of FIG. 3A is the width direction of the paper P. Further, the lower side in the up-and-down direction of FIG. 3A corresponds to the front side of the paper P and the upper side corresponds to the back side of the paper P.

The first movable blade 21 has a center end and a side end in the width direction of the paper. The second movable blade 22 has a center end and a side end in the width direction of the paper. The center end of the first movable blade 21 faces the center end of the second movable blade 22. The side end of the first movable blade 21 is on one side and the side end of the second movable blade 22 is on the other side in the width direction of the paper. The first movable blade 21 has a circular origin hole 213, an oval reference hole 214 formed with two parallel straight edges and two circular arc edges, and a first engagement hole 215 with which a jig is to be engaged as described later. The distance of the two straight edges of the reference hole 214 is the same as the diameter of the origin hole 213. The first mounting member 23 is provided with two cylindrical protrusions 231, of which diameter is slightly smaller than that of the origin hole 213 of the first movable blade 21. These two protrusions 231 are respectively inserted in the origin hole 213 and the reference hole 214 of the first movable blade 21, and thereby a position of the first movable blade 21 with respect to the first mounting member 23 is decided. The first movable blade 21 is mounted on the first mounting member 23 with two screws 71 at the decided position.

The second movable blade 22 has two oval reference holes 223 respectively formed with two parallel straight edges and two circular arc edges and a second engagement hole 224 with which a jig is to be engaged as described later. The reference hole 223 has a longitudinal side in the width direction of the paper. The second mounting member 24 is provided with two cylindrical protrusions 241, of which diameter is slightly smaller than the distance of the two straight edges of the reference hole 223 formed on the second movable blade 22. These two protrusions 241 are respectively inserted in the reference holes 223 of the second movable blade 22, and thereby the second movable blade 22 is prohibited from moving in the advancing and retracting direction of the slide unit 20. With the two protrusions 241 being inserted in the reference holes 223, the second movable blade 22 is positionally adjustable in the width direction of the paper with respect to the second mounting member 24. The second movable blade 22 is mounted on the second mounting member 24 with two screws 72 after a gap S (referring FIG. 3B) is provided with respect to the first movable blade 21, of which width is appropriately adjusted.

The first mounting member 23 has a pair of raised portions 233 which are bent toward the direction vertical to the paper surface of FIG. 3A. The slide frame 25 also has a pair of first raised portions 252 which are bent toward the direction vertical to the paper surface of FIG. 3A. The raised portions 233 of the first mounting member 23 is provided with throughholes penetrating in the paper width direction. The first raised portions 252 of the slide frame 25 are also provided with throughholes penetrating in the paper width direction. A first mounting shaft 31 having an axis substantially parallel with the width direction of the paper P is inserted into the throughholes of the raised portions 233 and 252. Accordingly, the first mounting member 23 is mounted on the slide frame 25 to be rotatable around the first mounting shaft 31. Therefore, the first movable blade 21 mounted on the first mounting member 23 is also rotatable with respect to the slide frame 25. The first mounting shaft 31 is mounted on the slide frame 25 with the snap rings 32*a* and 32*b* so as not to be movable in its longitudinal direction.

Further, a snap ring 32*c* is mounted on the first mounting shaft 31 at the center portion thereof in its longitudinal direction. A first coiled compression spring 33 is provided between the snap ring 32*c* and one of the raised portions 233 of the first mounting member 23, which is located at the center in the width direction of the paper. The first compression spring 33 is merely an exemplary embodiment of the urging member. The first mounting shaft 31 is inserted through the first compression spring 33. The first mounting member 23 is urged by the first compression spring 33 toward the center in the width direction of the paper.

A gap is provided between the raised portion 233 of the first mounting member 23 and the first raised portion 252 of the slide frame 25 in the axial direction of the first mounting shaft 31. Without this gap, the pair of raised portions 233 of the first mounting member 23 would be press-fitted between the pair of first raised portions 252 of the slide frame 25, and thereby the rotating of the first mounting member 23 with respect to the slide frame 25 is prevented. With the gap being provided, the first mounting member 23 is allowed to move in the axial direction of the first mounting shaft 31. In this embodiment, however, the first mounting member 23 is urged by the first compression spring 33 to restrict the movement in the axial direction of the first mounting shaft 31. In other words, the first mounting member 23 is urged toward the center in the width direction of the paper and restricted to move from a predetermined position in the width direction of the paper. Therefore, the first movable blade 21 mounted on the first mounting member 23 is also restricted to move from a predetermined position in the width direction of the paper.

A second compression spring 34 is provided between the slide frame 25 and the first mounting member 23. The first mounting member 23 is urged by the second compression spring 34 toward the rotating direction of the first movable blade 21 around the first mounting shaft 31, which is the direction vertical to the paper surface of FIG. 3A.

The second mounting member 24 has a pair of raised portions 243 which are bent toward the direction vertical to the paper surface of FIG. 3A. The slide frame 25 has a pair of second raised portions 253 which are bent toward the direction vertical to the paper surface of FIG. 3A. The raised portions 243 of the second mounting member 24 is provided with throughholes. The second raised portions 253 of the slide frame 25 is also provided with throughholes. A second mounting shaft 35 having an axis substantially parallel with the width direction of the paper P is inserted into the throughholes of the raised portions 243 and 253. Accordingly, the second mounting member 24 is mounted on the slide frame 25 to be rotatable around the second mounting shaft 35. Therefore, the second movable blade 22 mounted on the second mounting member 24 is also rotatable with respect to the slide frame 25. The second mounting shaft 35 is mounted on the slide frame with the snap rings 38*a* and 38*b* so as not to be movable in its length direction.

Further, a snap ring 38*c* is mounted on the second mounting shaft 35 at the center portion thereof in its length direction. A third coiled compression spring 36 is provided between the snap ring 38*c* and the raised portion 243 of the second mounting member 24, which is located at the center in the width direction of the paper. The third compression spring 36 is merely an exemplary embodiment of the urging member. The compression springs 33 and 36 may be replaced with other elastic member such as an extension spring, a torsion coil spring or a rubber. The second mounting shaft 35 is inserted through the third compression spring 36. The second mounting member 24 is urged by the third compression spring 36 toward the center in the width direction of the paper.

A gap is provided between the raised portion 243 of the second mounting member 24 and the second raised portion 253 of the slide frame 25 in the axial direction of the second mounting shaft 35. Without this gap, the pair of raised portions 243 of the second mounting member 24 would be press-fitted between the pair of raised portions 253 of the slide frame 25, and thereby the rotation of the second mounting member 24 with respect to the slide frame 25 is prevented. With the gap being provided, the second mounting member 24 is allowed to move in the axial direction of the second mounting shaft 35. In this embodiment, however, the second mounting member 24 is urged by the third compression spring 36 to restrict the movement in the axial direction of the second mounting shaft 35. In other words, the second mounting member 24 is urged toward the center in the width direction of the paper and is restricted to move from a predetermined position in the width direction of the paper. Therefore, the second movable blade 22 mounted on the second mounting member 24 is also restricted to move from a predetermined position in the width direction of the paper.

A fourth compression spring 37 is provided between the slide frame 25 and the second mounting member 24. The second mounting member 24 is urged by the fourth compression spring 37 toward the rotating direction of the second movable blade 22 around the second mounting shaft 35, which is the direction vertical to the paper surface of FIG. 3A.

Figure 3B:
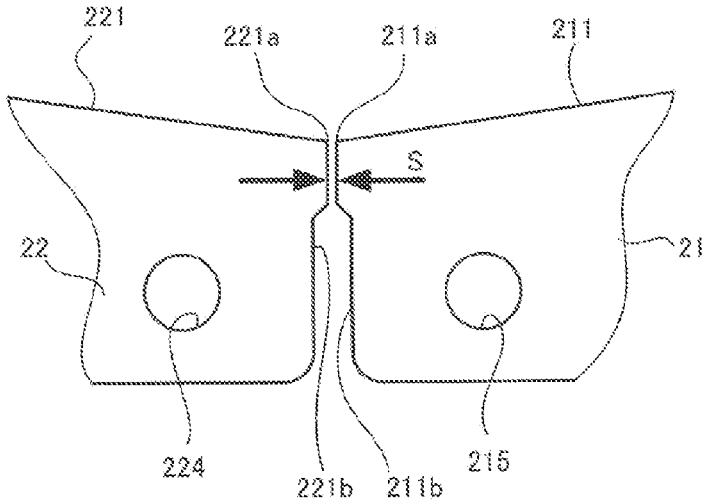
FIG. 3B is an enlarged view of the portion A of FIG. 3A.

FIG. 3B is an enlarged view of the portion A of FIG. 3A.

As shown in FIG. 3B, the first movable blade 21 and the second movable blade 22 are arranged with the gap S provided therebetween in the width direction of the paper P. The gap S may be extremely narrow, for example, about 0.3 mm in this exemplary embodiment. Accordingly, the first movable blade 21 is close to the second movable blade 22 in the width direction of the paper P. Particularly, the first movable blade 21 and the second movable blade 22 are arranged in such manner as an end point 211*a* of the cutting edge 211 is close to an end point 221*a* of the cutting edge 221. That is, the extremely narrow gap S is provided between the cutting edge 211 of the first movable blade 21 and the cutting edge 221 of the second movable blade 22.

As discussed above, the first movable blade 21 and the second movable blade 22 are restricted to move in the width direction of the paper. If the gap S is extremely narrow while the first movable blade 21 and the second movable blade 22 are allowed to move in the width direction of the paper, there is a risk that they would possibly touch each other, and otherwise the gap S would be possibly increased by the total moving distance of the first movable blade 21 and the second movable blade 22. In this exemplary embodiment, the first movable blade 21 and the second movable blade 22 are respectively urged by the first compression spring 33 and the third compression spring 36 toward the direction reducing the gap S. The gap S is therefore not altered even after the cutter apparatus 1 is assembled. By this configuration, the gap S is maintained at a desired width. Therefore, the gap S can be set to a extremely narrow width without a risk that the first movable blade 21 and the second movable blade 22 touch each other. In addition, the gap S can be adjusted to a desired size before the second movable blade 22 is mounted on the second mounting member 24 with the screw 72.

The center end of the first movable blade 21 has a straight portion extended from the cutting edge 211 toward the retracting direction of the first movable blade 21. This straight portion may have any length as long as not to harm the durability of the first movable blade 21. The length in this embodiment is 2 mm, but it may be 1 mm, for example. The center end of the first movable blade 21 further has a recessed portion 211*b* following the straight portion in the retracting direction of the first movable blade 21. The recessed portion 211*b* is recessed toward the direction away from the second movable blade 22. The relative position of the straight portion with respect to the first engagement hole 215 is strictly set in the manufacture of the first movable blade 21.

The center end of the second movable blade 22 has a straight portion extended from the cutting edge 221 toward the retracting direction of the second movable blade 22. This straight portion may have any length as long as not to harm the durability of the second movable blade 22. The length in this embodiment is 2 mm, but it may be 1 mm, for example The end of the second movable blade 22 further has a recessed portion 221*b* following the straight portion in the retracting direction of the second movable blade 22. The recessed portion 221*b* is recessed toward the direction away from the first movable blade 21. The relative position of the straight portion with respect to the second engagement hole 224 is strictly set in the manufacture of the second movable blade 22.

In this exemplary embodiment, even if the gap is reduced and therefore the first movable blade 21 and the second movable blade 22 touch each other, the recessed portions 211*b* and 221*b* would reduce friction of the first movable blade 21 and the second movable blade 22. The recessed portion may be provided on only one of the first movable blade 21 and the second movable blade 22.

Hereinafter, an operation of the cutter apparatus 1 according to an exemplary embodiment of the present invention will be described.

Figure 4A:
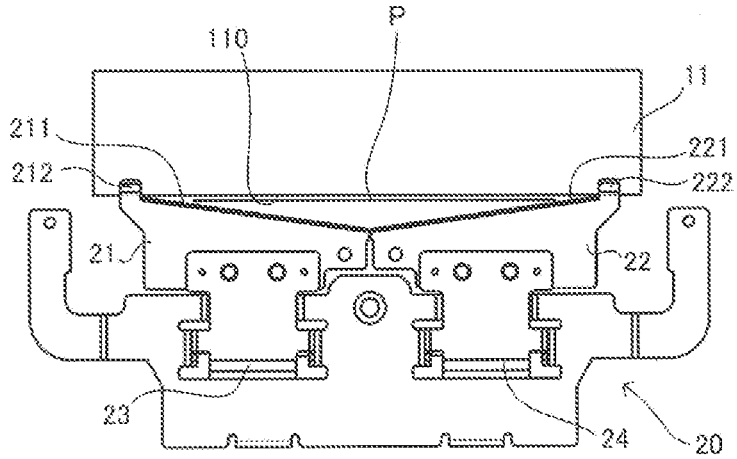
FIGS. 4A to 4C are top views of the cutter apparatus showing the moving status of the slide unit approaching to the fixed blade.
Figure 4B:
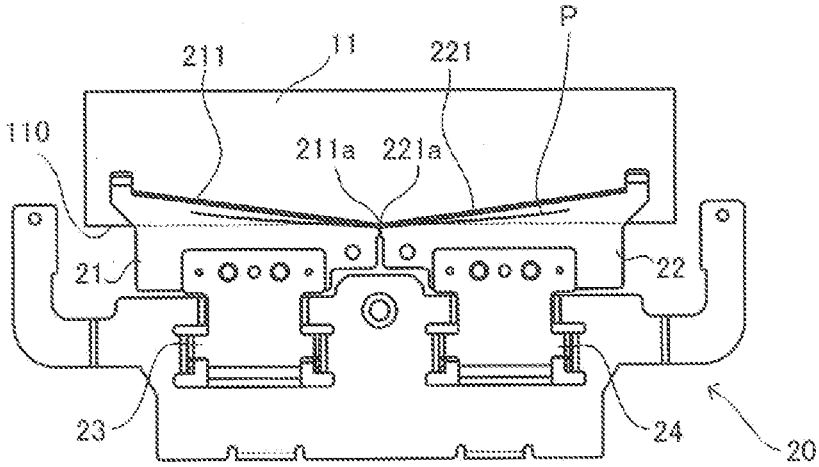
Figure 4C:
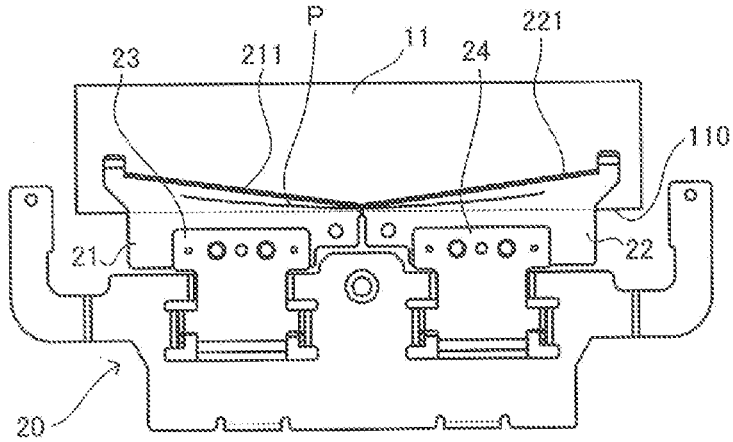
Figure 5A:
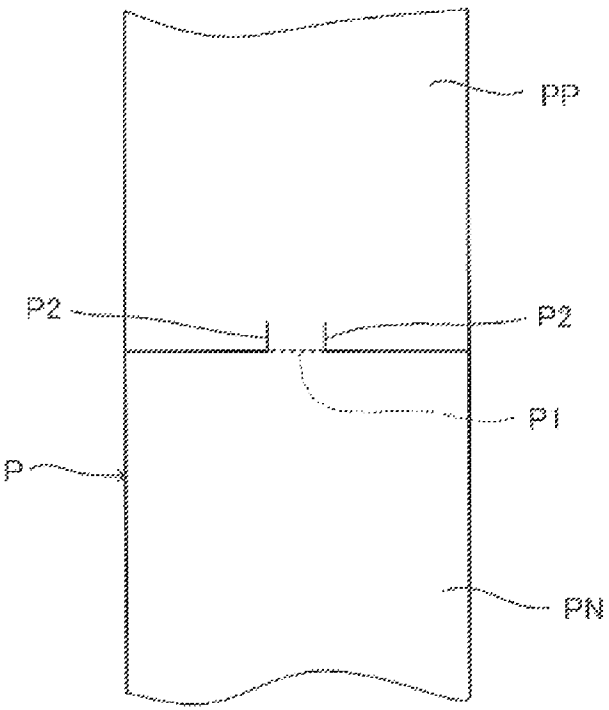
FIG. 5A is a schematic view of a paper partially cut by the cutter apparatus of prior art of Document 4.
Figure 5B:
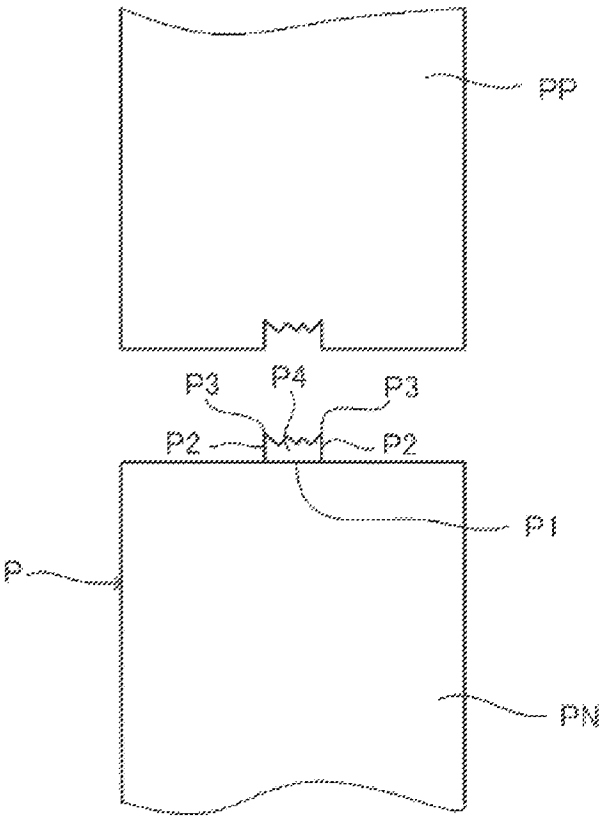
FIG. 5B is a schematic view of the paper fully cut by the cutter apparatus of prior art of Document 4.

FIGS. 4A to 4C are top views of the cutter apparatus showing the moving status of the slide unit approaching to the fixed blade. In FIGS. 4A to 4C, the fixed blade 11, the slide unit 20, and the paper P is viewed from the top side of FIG. 1.

In FIG. 4A, the slide unit 20 is moved from the home position shown in FIG. 2 toward the fixed blade 11 by the rotation of the motor 261. The most projecting portions in the cutting edges 211 and 221 of the first movable blade 21 and the second movable blade 22 are brought into contact with the cutting edge 110 of the fixed blade 11. The first movable blade 21 is guided by the guide 212 and the second movable blade 22 is guided by the guide 222 respectively to climb on the downstream surface of the fixed blade 11.

The first movable blade 21 and the second movable blade 22 are pressed against the cutting edge 110 of the fixed blade 11 respectively by the second compression spring 34 and the fourth compression spring 37 as shown in FIG. 3A. The second compression spring 34 urges the first movable blade 21 toward the fixed blade 11 so that the cutting edge 211 of the first movable blade 21 is pressed against the cutting edge 110 of the fixed blade 11. The fourth compression spring 37 urges the second movable blade 22 toward the fixed blade 11 so that the cutting edge 221 of the second movable blade 22 is pressed against the cutting edge 110 of the fixed blade 11.

As the slide unit 20 is moved from the position of FIG. 4A in the advancing direction, the first movable blade 21 gradually slides on the downstream surface of the fixed blade 11 with the cutting edge 211 of the first movable blade 21 being in contact with the cutting edge 110 of the fixed blade 11 at a point. The second movable blade 22 also gradually slides on the downstream surface of the fixed blade 11 with the cutting edge 221 of the second movable blade 22 being in contact with the cutting edge 110 of the fixed blade 11 at a point. The paper P, which is caught between the first and second movable blades 21, 22 and the fixed blade 11, is cut at the contact points from both ends to the center in the paper width direction.

According to the present exemplary embodiment, the first movable blade 21 and the second movable blade 22 are independently pressed against the fixed blade 11. In addition, since the gap S is provided between the first movable blade 21 and the second movable blade 22, the first movable blade 21 and the second movable blade 22 are prevented from touching each other, and therefore pressure on the fixed blade 11 is not subject to change. Thus, the first movable blade 21 and the second movable blade 22 are moved in the advancing direction with the desired pressure, which is applied respectively by the second compression spring 34 and the fourth compression spring 37, kept with respect to the fixed blade 11.

In FIG. 4B, the slide unit 20 is further moved from the position of FIG. 4A in the advancing direction until the end points 211*a* and 221*a* of the cutting edges 211 and 221 are brought into contact with the cutting edge 110 of the fixed blade 11. In FIG. 4B, the paper P is cut except the portion corresponding to the gap S, and thereby the printed part of paper is only connected with the non-printed part by the uncut portion having the same width as the gap S.

In FIG. 4C, the slide unit 20 is further moved from the position of FIG. 4B in the advancing direction. As the slide unit 20 is advanced, the uncut portion and the neighborhood thereof is pushed by the movable blades 21 and 22 toward the advancing direction, which is the thickness direction of the paper P, and further pushed upward in a direction away from the non-printed part of paper. Being pushed, the uncut portion is subject to a tearing force so that the printed part of paper is entirely separated from the non-printed part. The uncut portion is pushed upward by a distance corresponding to the thickness of the first movable blade 21 and the second movable blade 22. The width of the uncut portion is preferably set shorter than the distance corresponding to the thickness of the movable blade to allow the uncut portion to be easily torn before getting on the first movable blade 21 and the second movable blade 22. According to the present exemplary embodiment, the uncut portion has an extremely narrow width equal to the gap, thereby the uncut portion is surely torn off by the tearing force to be applied when pushed. The width of the uncut portion is preferably half or less the thickness of the movable blades 21 and 22 to achieve a sure cut. The width of the gap S is preferably set larger than 0 mm and less than 0.5 mm to allow the uncut portion to be surely torn during the advancement of the slide unit 20 from the position of FIG. 4B to the position of FIG. 4C. In the present exemplary embodiment, the uncut portion has a width of 0.3 mm which is equal to the width of the gap S. In the case the thickness of the first movable blade is different from that of the second movable blade, the width of the gap S is preferably half or less the thickness whichever the movable blade is thicker.

Hereinafter, assembling of the slide unit will be described.

First, the first mounding member 23 is mounted on the slide frame 25. The first mounting shaft 31 is inserted into the throughholes of the pair of raised portions 252 of the side frame 25 and the throughholes of the pair of raised portions 233 of the first mounting member 23, and then through the first compression spring 33. The snap rings 32*a*, 32*b*, and 32*c* are then mounted on the first mounting member 23. The second mounding member 24 is mounted on the slide frame 25. The second mounting shaft 35 is inserted into the throughholes of the pair of raised portions 253 of the side frame 25 and the throughholes of the pair of raised portions 243 of the second mounting member 24, and then through the third compression spring 36. The snap rings 38*a*, 38*b*, and 38*c* are then mounted on the second mounting member 24.

Second, the first movable blade 21 is positioned with respect to the first mounting member 23 and then fixed with the screw 71. The protrusions 241 of the second mounting member 24 are inserted into the reference holes 223 of the second movable blade 22 and then the second movable blade 22 is temporarily fixed on the second mounting member 24 with the screw 72, which is loosely fastened. The temporarily-fixed second movable blade 22 is adjustable in position in the width direction of the paper with respect to the second mounting member 24. The jig having two parallel shafts is used. One of the shafts is inserted into the first engagement hole 215 of the first movable blade 21 and the other into the second engagement hole 224 of the second movable blade 22. The shafts of the jig have a diameter slightly smaller than that of the engagement holes 215 and 224. A distance between the shafts of the jig is set corresponding to a desired width of the gap S. The width of the gap S is fixed by the jig with one shaft inserted into the first movable blade 21 and the other shaft into the second movable blade 22. Then, while the jig is engagement with the first movable blade 21 and the second movable blade 22, the screw 72 is tightly fastened to fix the second movable blade 22 to the second mounting member 24.

Finally, the second compression spring 34 is mounted between the slide frame 25 and the first mounting member 23 and the fourth compression spring 37 is mounted between the slide frame 25 and the second mounting member 24. By the foregoing process, the slide unit 20 is easily assembled with the gap S assured at a desired width.

As discussed above, in the cutter apparatus and the thermal printer according to the present exemplary embodiment, the gap S is provided between the first movable blade 21 and the second movable blade 22 in such manner as the gap width is maintained to a desired value by the first compression spring 33 and the third compression spring 36. Each of the first movable blade 21 and the second movable blade 22 is therefore brought into contact with the fixed blade 11 with a desired pressure, achieving a sure cut.

Further, since the gap width is set to be extremely narrow, the width of the uncut portion is also extremely narrow. Therefore, only the advancing movement of the first movable blade 21 and the second movable blade 22 provides a full cut, eliminating the need of an auxiliary cutting edge.

Further, since the second movable blade 22 is positionally adjustable in the width direction of the paper with respect to the second mounting member 24, the gap width is adjustable to a desired value.

Further, since the first engagement hole 215 is provided on the first movable blade 21 and the second engagement hole 224 is provided on the second movable blade 22, the cutter apparatus 1 is easily assembled while the gap S of a desired width is defined by using the jig.

Further, since the width of the uncut portion of paper is extremely narrow, only small amount of paper dust is produced when the uncut portion is torn. Further, eliminating the need for an auxiliary cutting edge, which is difficult to be sharpened, simplifies the manufacture of the movable blades 21 and 22 and further reduces the amount of paper dust.

Further, since the compression springs 33 and 36, which provide a stable urging force, are used, the first movable bade 21 mounted on the first mounting member 23 and the second movable blade 22 mounted on the second mounting member 24 are respectively urged toward the directions reducing the gap S. Further, since the compression springs 34 and 37, which provide a stable urging force, are used, the first movable blade 21 and the second movable blade 22 are pressed against the fixed blade 11 respectively with a uniform pressure.

The present invention is not limited to the above-mentioned embodiments, and various modifications can be made within the scope of the following claims. For example, although the first movable blade 21 is provided with the origin hole 213 and the reference hole 214 while the first mounting member 23 is provided with the protrusions 231 in the embodiments, the first movable blade 21 may be provided with the protrusions 231 while the first mounting member 23 may be provided with the origin hole 213 and the reference hole 214. Likewise, the second mounting member 24 may be provided with the reference holes and the second movable blade 22 may be provided with the protrusions. Further, although the position of the second movable blade 22 with respect to the second mounting member 24 is adjustable in the embodiment, the position of the first movable blade 21 with respect to the first mounting member 23 may be adjustable. Further, both positions of the first movable blade 21 and the second movable blade 22 may be adjustable. The first engagement hole 215 and the second engagement hole 224 may be replaced with protrusions and a jig having holes to receive the protrusions may be used to assemble the cutter apparatus 1. Further, the first engagement hole 215 and the second engagement hole 224 may be replaced with recesses.

The above-mentioned modifications may be appropriately combined. An element merely included in a modification may be applied to other modifications.

What is claimed is:

1. A cutter apparatus for cutting a paper, comprising:

a fixed blade;

a first movable blade disposed on one side in a width direction of the paper and configured to move back and forth with respect to the fixed blade in a direction perpendicular to the width direction of the paper;

a second movable blade disposed on the other side in the width direction of the paper with a gap provided with respect to the first movable blade and configured to move back and forth with respect to the fixed blade in a direction perpendicular to the width direction of the paper; and an urging member configured to continuously urge each of the first movable blade and the second movable blade in a direction reducing the gap for maintaining the gap at a predetermined width.

2. The cutter apparatus of claim 1, further comprising:

a first mounting member on which the first movable blade is mounted and a second mounting member on which the second movable blade is mounted, wherein at least one of the first movable blade and the second movable blade is positionally adjustable in the width direction of the paper with respect to the relevant mounting member.

3. The cutter apparatus of claim 2, wherein each of the first movable blade and the second movable blade comprises an engagement portion with which a jig is engaged, the jig being used to define the width of the gap when each of the first movable blade and the second movable blade is mounted on the relevant mounting member.

4. A printer comprising:

a conveying unit configured to convey a paper;

a printing unit configured to print onto the paper conveyed by the conveying unit; and the cutter apparatus according to claim 1 provided downstream from the printing unit in a paper conveying direction.

5. The printer of claim 4, wherein the cutter apparatus further comprises a first mounting member on which the first movable blade is mounted and a second mounting member on which the second movable blade is mounted, wherein at least one of the first movable blade and the second movable blade is positionally adjustable in the width direction of the paper with respect to the relevant mounting member.

6. The printer of claim 5, wherein each of the first movable blade and the second movable blade comprises an engagement portion with which a jig is engaged, the jig being used to define the width of the gap when each of the first movable blade and the second movable blade is mounted on the relevant mounting member.

* * * * *